US005487197A

United States Patent [19]

Iskra, Jr. et al.

[11] Patent Number: 5,487,197

[45] Date of Patent: Jan. 30, 1996

[54] PNEUMATIC WHEELCHAIR CUSHION

[76] Inventors: Joseph W. Iskra, Jr., 519 Dornoch; John A. Havener, 1200 Astoria, both of St. Louis, Mo. 63137

[21] Appl. No.: 286,742

[22] Filed: Aug. 5, 1994

[51] Int. Cl.[6] ..... A47C 27/08; A47C 7/02; A61G 7/057

[52] U.S. Cl. ..... 5/654; 5/453; 297/452.41; 297/DIG. 3

[58] Field of Search ..... 5/654, 653, 449, 5/451, 453, 455, 456, 644, 4; 297/DIG. 3, 452.41, 284.6

[56] References Cited

U.S. PATENT DOCUMENTS

| | | | |
|---|---|---|---|
| 2,612,645 | 10/1952 | Boland | 5/633 |
| 3,112,956 | 12/1963 | Schick et al. | 5/654 |
| 3,276,047 | 10/1966 | Emery | 5/654 |
| 3,296,635 | 1/1967 | O'Hanlan | 5/654 |
| 3,297,023 | 1/1967 | Foley | 128/33 |
| 3,303,518 | 2/1967 | Ingram | 5/349 |
| 3,446,203 | 5/1969 | Murray | 128/24.2 |
| 4,115,885 | 9/1978 | Davis | 5/654 |
| 4,175,297 | 11/1979 | Robbins et al. | 5/284 |
| 4,796,948 | 1/1989 | Paul et al. | 297/284 |
| 4,852,195 | 8/1989 | Schulman | 5/453 |
| 4,864,671 | 9/1989 | Evans | 5/453 |
| 5,052,068 | 10/1991 | Graebe | 5/654 |
| 5,163,737 | 11/1992 | Navach et al. | 297/459 |
| 5,189,742 | 3/1993 | Schild | 5/453 |
| 5,193,237 | 3/1993 | Holdredge | 5/654 |
| 5,369,829 | 12/1994 | Jay | 5/654 |

OTHER PUBLICATIONS

Embracing Concepts, Inc., ISCH–DISH™ Pressure Relief Cushion, brochure © 1992.

Jay Medical, Ltd., Jay® Active, brochure © 1986.

Jay Medical, Ltd., Jay Medical Combi® Posture Seating System, brochure © 1988.

Sunrise Medical, Inc., The Orthoderm™ Consummate Air Therapy Bed, brochure © 1993.

Creative Medical, Inc., Stage IV Low Airloss Alternating Mattress Overlay, brochure.

*Primary Examiner*—Alexander Grosz

*Attorney, Agent, or Firm*—Grace J. Fishel

[57] ABSTRACT

A pneumatic wheelchair cushion system has an air cushion with adjoining separate chambers for cushioning a user's coccyx, ischial tuberosities, greater trochanters and thighs. The chambers are pneumatically interconnected with each other such that pressure on one or more of the chambers is transmitted to the other chambers and to a control module with a controller for maintaining an inflation pressure in the air cushion within an upper and a lower set point.

6 Claims, 2 Drawing Sheets

PNEUMATIC WHEELCHAIR CUSHION

BACKGROUND OF THE INVENTION

1. Field of the Invention

The present invention relates to a wheelchair cushion with pneumatically connected chambers, the inflation of which is monitored, for cushioning the coccyx, ischial tuberosities, greater trochanters and thighs.

2. Brief Description of the Prior Art

Patients confined to wheelchairs face the prospect of development of decubitus ulcers or "bed sores" on their buttocks, the best treatment of which is prevention. These ulcers form at bony locations when prolonged sitting pressure reduces blood circulation below the level required to sustain tissue life. Skin breakdown can also occur when the patient is seated on a wheelchair cushion that does not provide adequate ventilation and causes the skin to be excessively moist and warm for protracted periods. A healthy subject seated in a chair will feel pain or discomfort from the pressure and heat build up and change positions but if the patient is paralyzed, elderly or otherwise disabled, disoriented or sick, he may not be aware of the problem or may not be able to move. One additional factor contributing to tissue destruction is shear forces encountered between the patient's buttocks, clothing and the wheelchair cushion in sitting down or changing position.

Various wheelchair cushions have been proposed to reduce the risk of skin breakdown by spreading the patient's weight over his buttocks. Such cushions include air or fluid filled cushions, foam composition cushions and gel filled cushions. Gel and foam cushions produce too much pressure against the skin as they are compressed against the bony regions and contribute to moisture and heat build up. Fluid filled cushions (e.g., water) provide a heat sink but are heavy and subject to leaking. Air filled cushions have been provided in passive form (inflation pressure does not change) and in dynamic form (selected cells are alternately inflated and deflated). Passive air cushions as a group do not permit air to communicate easily with the seated surface and afford little opportunity for heat and humidity to be transferred away. In addition, when the cushion is thick enough to keep the patient from bottoming out, it is often unsteady and difficult for a person with impaired body balance to use. Passive air cushions are also susceptible to leaking. If the patient is paralyzed or is not aware of the leak, he may continue to sit on the deflated cushion and sustain tissue damage. Air cushions of the dynamic form also suffer from moisture and heat transfer problems when the air cells are made of vinyl and other moisture vapor impervious materials and, more importantly, are expensive. The aging of the "Baby Boomers" beginning in the next decade with the prospect of increasing numbers of wheelchair bound patients and the current political and media attention being given to health care costs, make affordability a major issue.

Summary of the Invention

In view of the above, it is an object of the present invention to provide an affordable air cushion with good lateral stability and heat and humidity transfer. It is another object to provide a wheelchair cushion with means for alerting the patient or nursing staff that the cushion is leaking or under inflated before the patient sustains tissue damage from bottoming out. Other objects and features of the invention will be in part apparent and in part pointed out hereinafter.

In accordance with the invention, a pneumatic wheelchair cushion system has adjoining separate chambers for cushioning a user's coccyx, ischial tuberosities, greater trochanters and thighs. The chambers are interconnected such that pressure on one or more of the chambers is transmitted to the other chambers. The air cushion is also pneumatically connected to a control module for controlling an inflation pressure in the air cushion within a predetermined range. The chambers are constructed of a microporous fabric that is permeable to water vapor but blocks liquid water transmission.

The invention summarized above comprises the constructions hereinafter described, the scope of the invention being indicated by the subjoined claims.

BRIEF DESCRIPTION OF THE DRAWINGS

In the accompanying drawings, in which one of several possible embodiments of the invention are illustrated, corresponding reference characters refer to corresponding parts throughout the several views of the drawings in which.

DETAILED DESCRIPTION OF THE INVENTION

Figure 1:
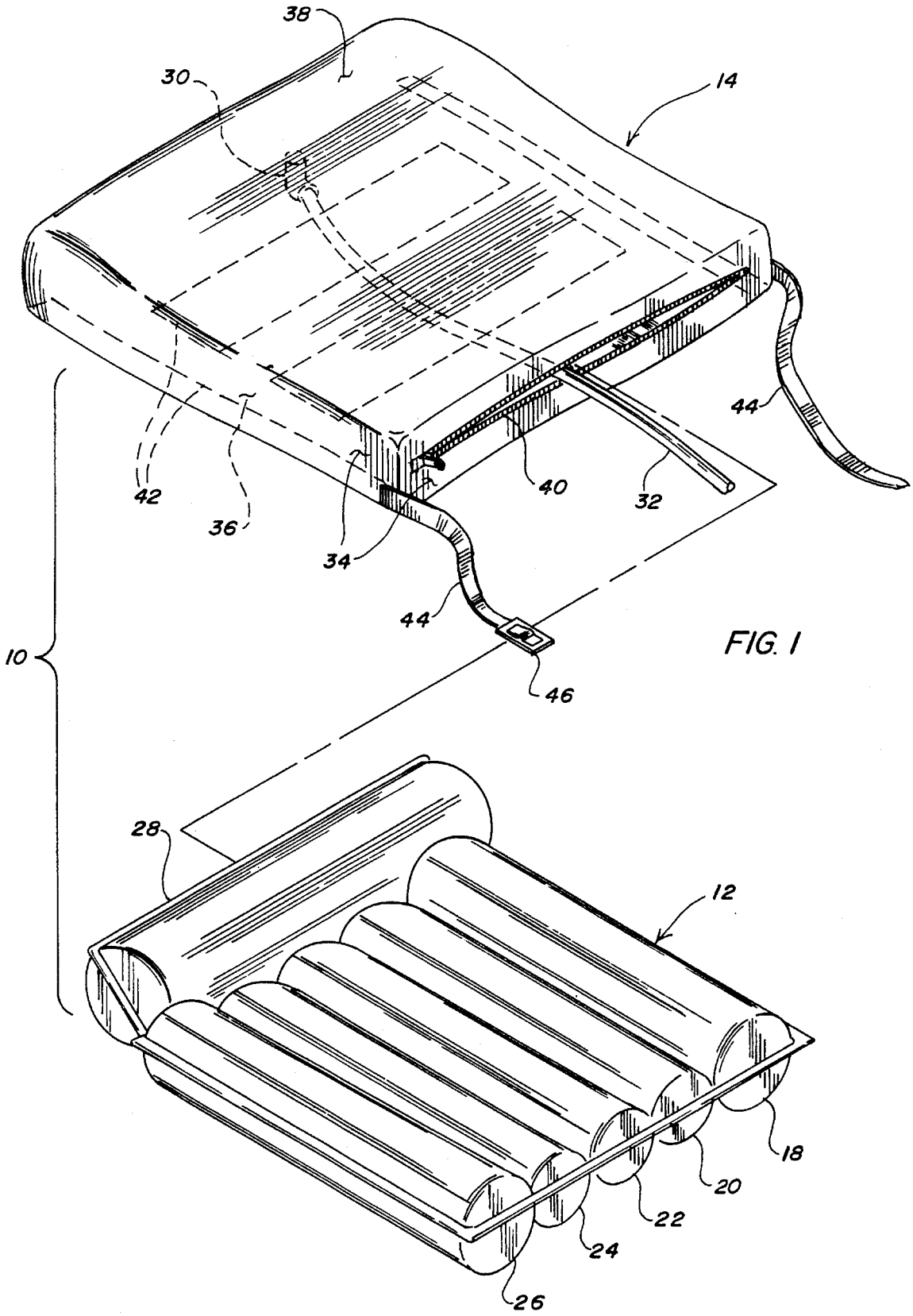
FIG. 1 an exploded view of an air cushion and cover in accordance with the present invention.

Referring to the drawings more particularly by reference character, reference numeral 10 refers to a pneumatic wheelchair cushion system in accordance with the present invention. System 10 includes an air cushion 12 with pneumatically connected chambers for cushioning the coccyx, ischial tuberosities, greater trochanters and thighs contained in a cover 14. A control module 16 with means for controlling the inflation pressure within a predetermined range is connected to air cushion 12.

Figure 2:
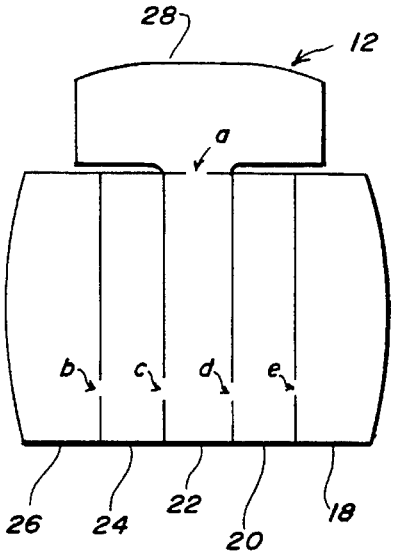
FIG. 2 is a top view of the air cushion in uninflated condition.
Figure 3:
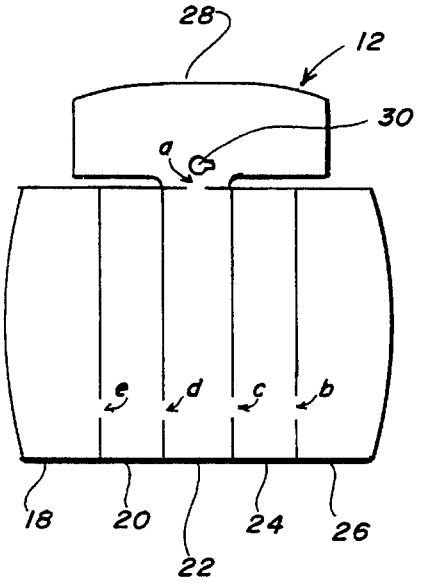
FIG. 3 is a bottom view of the air cushion in uninflated condition.

As shown in FIGS. 1–3, the pneumatically connected chambers comprise five adjoining lateral and one adjoining transverse, slightly flattened, tubes strategically located to cushion the bony prominences of the coccyx, ischial tuberosities, greater trochanters and thighs—namely, a right greater trochanter tube 18, a right ischial tuberosity tube 20, a coccyx tube 22, a left ischial tuberosity tube 24 and a left greater trochanter tube 26 and a femur tube 28. As best seen in FIG. 1, greater trochanter tubes 18, 26 are larger in cross-section than ischial tuberosity and coccyx tubes 20, 24 and 22 so that air cushion 12 is slightly concave when viewed from above, following the natural contours of the trochanters for better distribution of the patient's weight across his buttocks. For an air cushion 12 designed to fit a standard adult-sized wheelchair, air cushion 12 is about 16 inches deep and 18 inches wide, said tubes having the following widths when deflated, greater trochanter tubes 18, 26 measure about 6 inches, ischial tuberosity and coccyx tubes 20, 24 and 22 measure about 4 inches and femur tube 28 measures about 6 inches. For other sized wheelchairs, air cushion 12 and tubes 18–28 are scaled accordingly.

With continuing reference to FIGS. 1–3, the pneumatically connected chambers collectively contain and distribute static air pressure via a scheme of restrictive air passages a–e between the six tubes. Right greater trochanter tube 18 receives displaced internal air from right ischial tuberosity tube 20, by way of restrictive air passage e, when a bony prominence under weight load is applied. Left greater trochanter tube 26, receives displaced internal air from left ischial tuberosity tube 24, by way of restrictive air passage b. When force applied to coccyx tube 22, internal air pressure is distributed to femur tube 28 via restrictive air passage a, right ischial tuberosity tube 20 by way of restrictive air passage d and left ischial tuberosity tube 24 by way of restrictive air passage c. Restrictive passages b–e between adjacent lateral chambers, baffle movement of the air when the patient changes position, giving air cushion 12 good lateral stability. Femur tube 28 fills the void under the patient's knees and restrictive passage a affects the pressure exerted on the patient's thighs, allowing for a wide range of lateral movement of the patient's legs from the median plane of his body (i.e., abduction or adduction).

Air cushion 12 is constructed from a fabric characterized in that it is microporous, having a low transmission of air and water vapor, but which blocks liquid transmission. One suitable fabric, for example, is microporous water vapor permeable polyurethane film reinforced with nylon. Other suitable fabrics are coated, laminated or impregnated with a material such as expanded Teflon and are sold under various commercial names including Goretex which is manufactured by the W. L. Gore Company, Ultrex manufactured by Burlington Industries and Storm Shed manufactured by Reeves Brothers Manufacturing Company. Air cushion 12 may be formed of two layers of suitable fabric with the layers sealed together about the peripheral edges of tubes 18–28 by sonic welding or the like as shown in FIGS. 2–3. For better conformability to the buttocks of the user, the top surface may be made of lighter material than the bottom surface, a non-limiting example of which is when the bottom surface is made of a 6.5 mil layer of polyurethane reinforced with 420 denier nylon and the top surface made of a 4.0 mil layer of polyurethane reinforced with 200 denier nylon. Tubes 18–28 are pneumatically connected as described above, in simplest form, by leaving a gap in the peripheral seal between tubes. A valve 30, such as a 90 degree flange valve, is sealed in the bottom of femur tube 28 for connection of air cushion 12 to an air line 32.

The sides 34 and base 36 of cover 14 are preferably made of a light weight nylon fabric and top 38 is preferably made of a low shear fabric such as Lycra. The rear side of cover 14 may be provided with a zipper 40 or other closure means, through which air cushion 12 is inserted. Strips 42 of Velcro or other such male and female mating fastener material may be provided on base 36 for engagement with strips of opposite gender attached to the seat of the wheelchair. A pair of nylon straps 44 are attached at each rear corner of cover 14, one of which is provided with a buckle 46.

Figure 4:
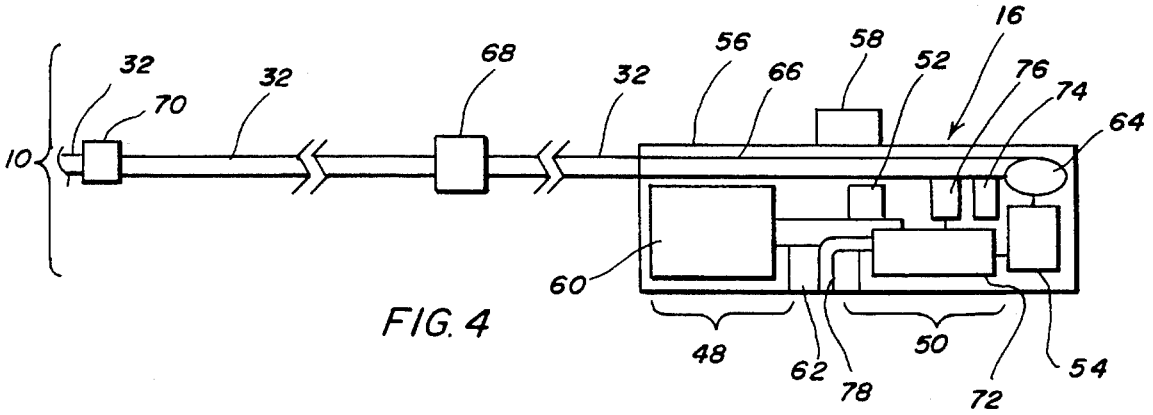
FIG. 4 is a schematic of a control module.

Control module 16 is illustrated schematically in FIG. 4 and includes a power source 48, a means 50 for controlling inflation pressure of air cushion 12 within an upper and a lower set point, an alarm 52 which signals loss of set point control and inability to achieve same within a predetermined time and a gas source 54. Control module 16 is preferably housed in an acid and weather resistant housing 56 with a mount 58 for attachment to a wheelchair. Mount 58 may be a metal fitting, straps, male/female mating fastener, etc. In the form illustrated, power source 48 includes a battery 60 and a DC converter 62 which allows control module 16 to operate on different batteries. Gas source 54 is a pump driven by a motor that moves air from outside block 64 into a plenum 66. Plenum 66 is pneumatically connected to air cushion 12 by means of air line 32, which may include an in-line, O-ring shutoff connector 68 and a barbed reducer union 70. Means 50 for controlling inflation pressure include a controller such as a microprocessor 72 programmed with an instruction set. When microprocessor 72 receives a signal from a pressure sensor such as a pressure transducer 74 in plenum 66, it compares the signal with the upper and lower set points. If the signal is below the lower set point, microprocessor 72 activates pump 54 which continues in operation until microprocessor receives a signal from pressure transducer 74 which is above the lower set point. Whereas if the signal from pressure transducer 74 is above the upper set point, microprocessor 72 signals a pressure relief valve such as an electronic pressure relief valve 76 to vent plenum 66 until the microprocessor receives a signal from pressure transducer 74 which is below the upper set point. Potentiometer 78 allows the user to set upper and lower set points and microprocessor 72 activates alarm 52 when the signal from pressure transducer 74 is out of set point control and system 10 is unable to achieve set point control within a predetermined time. Microprocessor 72 may also activate a light emitting diode when pump 54 is in operation and cause alarm 52 to emit a pulsed warning signal when the battery is below a predetermined level.

Before installing air cushion 12 on wheelchair, the seat surface and inner side areas of the chair should be inspected and any sharp edges or points eliminated. Strips of fastening material such as Velcro may be attached to the seat surface prior to placing air cushion 12 in cover 14 with mating strips on the seat. Straps 44 are routed around the back of the chair and secured with buckle 46 and then tightened. Power source 48 is attached to control module 16 by installing battery 60 or by attaching the control module to a power source for the wheelchair if it is motorized through DC converter 62. Using mount 58, control module 16 is attached to the wheelchair. Air line 32 is routed along the nonmoving parts of the wheelchair and attached to valve 30 in air cushion 12 and to plenum 66. When O-ring shutoff connector 68 is present, connection between control module 16 and air cushion 12 is achieved by locking sections of the connector together.

To adjust the inflation pressure of air cushion 12, the potentiometer is adjusted so that the upper set point is such that the air cushion will inflate firm and then a user should be positioned on the air cushion. If the air cushion is being used with abduction, adduction, lateral support or other means, these devices should be removed prior to adjusting the internal pressure of air cushion 12. As the potentiometer is slowly adjusted, lowering the upper set point, the user will gradually sink into air cushion 12. Adjustment of the potentiometer should continue, lowering the upper set point, until the user nearly bottoms out when he leans from side to side (e.g., with the user's ischium approximately ½ inch from the chair surface). As the upper set point is adjusted, controller 72 sets the lower set point at a level sufficient to keep the patient from bottoming out, while preferably maximizing the intervals between which pump 54 is activated. Minimal inflation is the key to spreading the user's weight over the maximum area of his buttocks and over-inflation or under-inflation will minimize or eliminate the efficiency of the air cushion. When the upper set point is determined, abductors, adductors, etc. may be repositioned.

When pump 54 is activated, a light emitting diode may be lighted on control module 16. If power source 48 becomes low or if pressure is lost in air cushion 12, alarm 52 is sounded alerting the patient or the nursing staff to the problem so that corrective action can be taken before tissue damage is done. Lycra top minimizes shear forces between the user's skin and clothing and the fabric out of which cover 14 and air cushion 12 are formed, permit water vapor and heat to pass through air cushion 12 keeping the patient's skin drier and cooler.

In view of the above, it will be seen that the several objects of the invention, including that of affordability, are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A generally rectangular pneumatic wheelchair cushion system comprising an air cushion with five adjoining lateral tubes, said lateral tubes comprising a right greater trochanter tube, a right ischial tuberosity tube, a coccyx tube, a left ischial tuberosity tube and a left greater trochanter tube, and one adjoining transverse tube for cushioning the user's thighs, said transverse tube comprising a femur tube, said tubes pneumatically interconnected with restricted passageways, one of which passageways interconnects the coccyx tube and the femur tube, such that pressure on one or more of the tubes is transmitted between the coccyx tube and femur tube and to the other tubes, and a control module with means for controlling an inflation pressure in the air cushion within an upper and a lower set point, said control module pneumatically connected to the air cushion, said right and left greater trochanter tubes being larger in cross-section than the right and left ischial tuberosity and coccyx tubes so that the air cushion is concave when viewed from above.

2. The system of claim 1 wherein the tubes are constructed of a microporous fabric that is permeable to water vapor but blocks liquid water transmission.

3. The system of claim 2 wherein the restricted passageways interconnecting the five lateral tubes and the transverse tube comprise a first restricted passageway between the right greater trochanter tube and the right ischial tuberosity tube, a second restricted passageway between the right ischial tuberosity tube and the coccyx tube, a third restricted passageway between the coccyx tube and the femur tube, a fourth restricted passageway between the coccyx tube and the left ischial tuberosity tube and a fifth restricted passageway between the left ischial tuberosity tube and the left greater trochanter tube.

4. The system of claim 3 wherein the control module additionally includes a power source, an alarm which signals loss of set point control and inability to achieve set point control within a predetermined time and an air pump pneumatically connected to a plenum, said plenum pneumatically connected to the air cushion with an air line.

5. The system of claim 4 wherein the means for controlling an inflation pressure in the air cushion within an upper and a lower set point comprises a controller, a pressure sensor in the plenum, a pressure relief valve to vent the plenum, said controller programmed with an instruction set so that when the controller receives a signal from the pressure sensor in the plenum, the controller compares the signal with the upper and lower set points, when the signal is below the lower set point, the controller activates the air pump which continues in operation until the controller receives a signal from the pressure sensor that is above the lower set point, and when the signal is above the upper set point, the controller activates the pressure relief valve which remains open until the controller receives a signal from the pressure sensor which is below the upper set point.

6. The system of claim 5 wherein the controller is a microprocessor and wherein a potentiometer connected to the microprocessor allows the user to set the upper and lower set points.

* * * * *